US005799452A

United States Patent [19]

Moore

[11] Patent Number: 5,799,452

[45] Date of Patent: Sep. 1, 1998

[54] LOG CONSTRUCTION

[76] Inventor: Kenneth G. Moore, RR#6 Lindsay, Ontario, Canada, K9V 4R6

[21] Appl. No.: 872,966

[22] Filed: Jun. 11, 1997

[51] Int. Cl.[6] ..... E04B 1/10

[52] U.S. Cl. ..... 52/233; 52/590.2

[58] Field of Search ..... 52/233, 589.1, 52/590.1, 590.2, 590.3, 592.4, 592.5, 592.6

[56] References Cited

U.S. PATENT DOCUMENTS

| | | | |
|---|---|---|---|
| 3,791,090 | 2/1974 | Kniefel . | |
| 4,599,837 | 7/1986 | Wrightman . | |
| 4,840,003 | 6/1989 | Lucas et al. | 52/233 |

FOREIGN PATENT DOCUMENTS

| | | | |
|---|---|---|---|
| 1242558 | 10/1988 | Canada | 52/233 |

OTHER PUBLICATIONS

Dialog Search Results (36 Pages).

IBM Web Site Results (33 Pages).

*Primary Examiner*—Creighton Smith

[57] ABSTRACT

A log construction has a pair of logs, each having an end region with a surface portion thereon, wherein the surface portions are arranged to engage one another at a boundary therebetween, the boundary having a length. At least one barrier extends across the boundary and along the length thereof to couple the end regions together, the barrier having a pair of projections. Each of the logs has a passage open to and adjacent the boundary for receiving a corresponding one of the projections. Each projection has a pair of outer surfaces and the passage having a pair of inner surfaces, the outer and inner surfaces being further arranged to generate residual compressive forces toward the boundary as a result of shrinkage between the barrier and the end regions.

17 Claims, 9 Drawing Sheets 16
12
12d
12f
12a
12b
12e
12g
12f
12c
10
14f
14h
14b
14d
14e
14a
14c
14g
14f
14

36
38
30
32
34
32d
33a
33b
32c
32b
34a
32a
33A

LOG CONSTRUCTION

BACKGROUND OF THE INVENTION

1. Field of the Invention

The present invention relates to log construction.

2. Description of the Related Art

Despite the advances in modern building construction techniques, the traditional log construction nonetheless remains popular, due to its aesthetic traditional appearance. Modern log buildings are commonly made in a prefabricated fashion at a factory site, and then delivered to the destination.

The most dominant disadvantage to log construction is that the log walls tend to be drafty, particularly due to long term shrinkage and settling, which exposes gaps between the log joints. As the shrinkage occurs, the log construction tends to lose some structural integrity due to loosening joints. Advances in packing materials have made significant advances in reducing air infiltration through the log wall, but problems still remain.

It is an object of the present invention to provide an improved log construction techniques.

SUMMARY OF THE INVENTION

Briefly stated, the invention involves a log construction comprising:

a pair of logs, each having an end region with a surface portion thereon, wherein the surface portions are arranged to engage one another at a boundary therebetween, the boundary having a length, at least one barrier extending across the boundary and along the length thereof to couple the end regions together, the barrier having a pair of projections, each of the logs further comprising a passage open to and adjacent the boundary for receiving a corresponding one of the projections, each of the projections having a pair of outer surfaces and the passage having a pair of inner surfaces, the outer and inner surfaces being further arranged to generate residual compressive forces toward the boundary as a result of shrinkage between the barrier and the end regions.

In another aspect of the present invention, there is provided a method of forming a log construction comprising the steps of:

providing a pair of logs, each with an end region having a surface portion thereon, arranging the surface portions are arranged to engage one another at a boundary therebetween, the boundary having a length, providing at least one barrier to extending across the boundary and along the length thereof to couple the end regions together, the barrier having a pair of projections, forming in each of the logs a passage open to and adjacent the boundary for receiving a corresponding one of the projections, forming on each of the projections a pair of outer surfaces and in the passage a pair of inner surfaces, arranging the outer and inner surfaces to generate residual compressive forces toward the boundary as a result of shrinkage between the barrier and the end regions.

BRIEF DESCRIPTION OF THE DRAWINGS

Several preferred embodiments of the present invention will now be described, by way of example only, with reference to the appended drawings in which.

DESCRIPTION OF THE PREFERRED EMBODIMENTS

Figure 1:
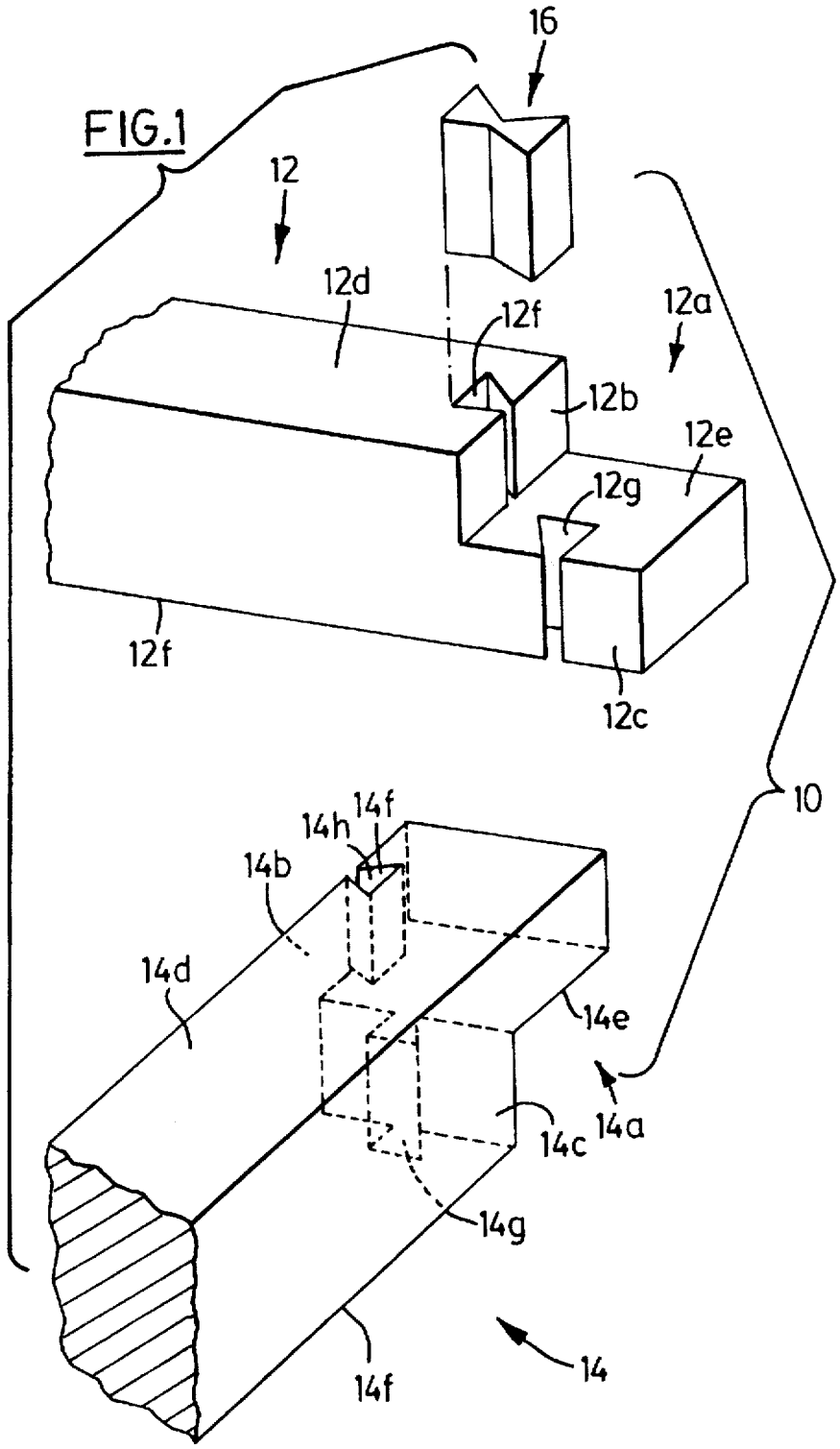
FIG. 1 is perspective assembly view of a log construction.
Figure 2:
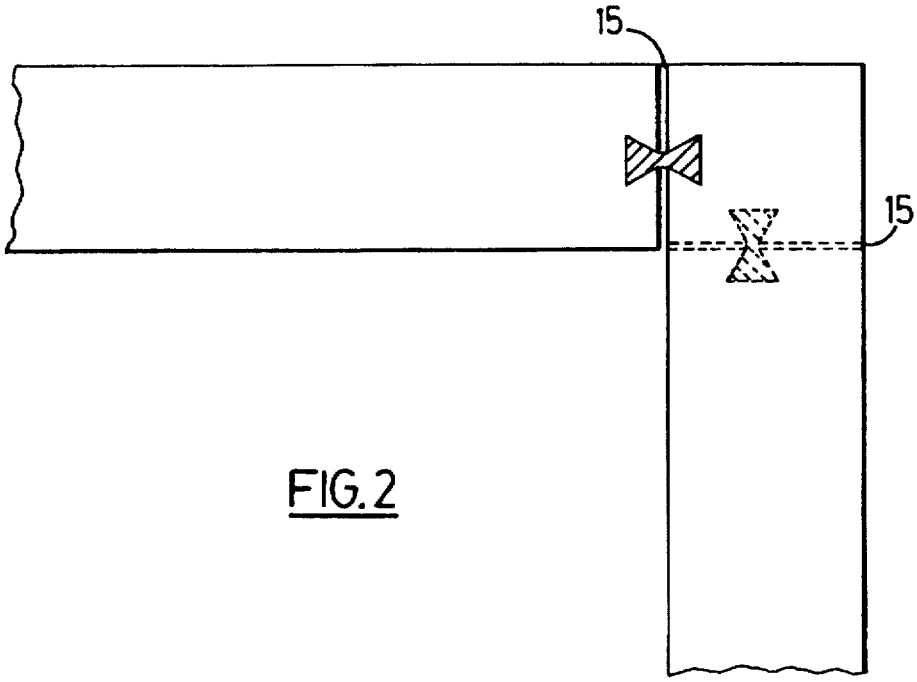
FIG. 2 is a fragmentary plan view of the log construction of FIG. 1.

Referring to the figures, there is provided a log construction 10 comprising a pair of logs 12, 14, each log having an end region 12*a*, 14*a* formed to engage one another, for example by a rectangular joint. The logs have adjacent first surface portions 12*b*, 14*b* and adjacent second surface portions 12*c*, 14*c*, each with a length 'W' between an outer surface 12*d*, 14*d* and an intermediate surface 12*e*, 14*e*. As seen in FIG. 2, the surface portions are, when assembled, separated by a boundary 15, and are preferably upright and planar. In this case, the boundary is shown to involve a large gap for illustrative purposes only.

The end regions further comprise first barrier receiving passages 12*f*, 14*f* adjacent the first surface portions and second barrier receiving passages 12*g*, 14*g* which are open to and adjacent the second surface portions and the boundary in their assembled condition.

A rigid barrier, in the form of a key 16, is provided to engage each pair of aligned passages 12*f*, 14*f* and 12*g*, 14*g*, to interrupt the boundary between the adjacent surface portions along substantially the entire length thereof, thereby to couple the end regions together.

Preferably, the key has a tensile strength, shear strength and a stiffness to inhibit bending and stretching relative to the central axis shown at 'A'. Once assembled, the key also has the capacity to inhibit displacement of one surface portion relative to its adjacent surface portion, thereby inhibiting relative movement of the logs, that is to inhibit displacement of one surface portion relative to another transverse to the boundary. The degree to which the key will inhibit such relative movement depends on the fit between the key and the aligned passages.

Figure 4:
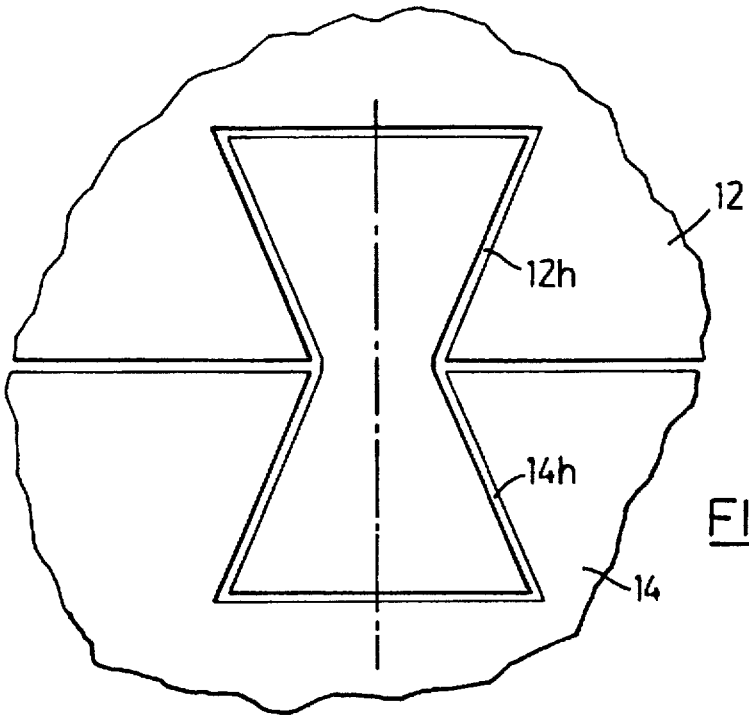
FIG. 4 is a magnified fragmentary plan view of a portion of the log construction of FIG. 1.

Each of the key receiving passages includes a bearing surface 12*h*, 14*h*, to establish a loaded condition with the barrier. In this manner, each of the bearing surfaces of one passage, has a corresponding opposed bearing surface in the other barrier receiving passage. This can be seen in FIG. 4 wherein the bearing surfaces 12h in log 12 are aligned with the opposed passages 14h in log 14.

The outer surfaces of the projections and the corresponding inner surfaces of the passages are complementary and are further arranged to generate residual compressive forces toward the boundary as a result of shrinkage between the barrier and the end regions, thereby to establish this compressive loading. Further, the keys and their corresponding passages may be configured to establish tensile loading on the key and consequently compressive loading on the bearing surfaces in order to have the effect of drawing the logs together, that is to minimize the spacing between the surface portions at the boundary 15. Therefore, the tensile strength and stiffness should be sufficient to withstand these forces.

The key 16 has a pair of aligned webs 16a, 16b, each shaped to fit snugly within a corresponding one of the barrier receiving passages (though a loose fitting is shown for illustrative purposes). The webs 16a, 16b are also joined by a central portion 16c to extend across the boundary 15. Each of the projections includes a pair of bearing surface portions 16d, 16e for engaging a corresponding bearing surface in the barrier receiving passage.

Figure 4B:
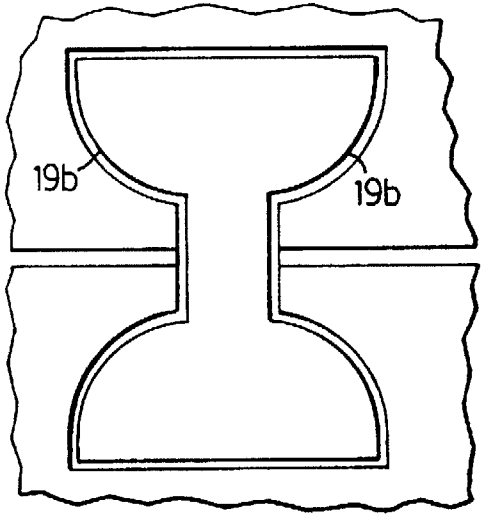
FIG. 4*a* and 4*b* magnified fragmentary plan views of other log constructions.
Figure 4A:
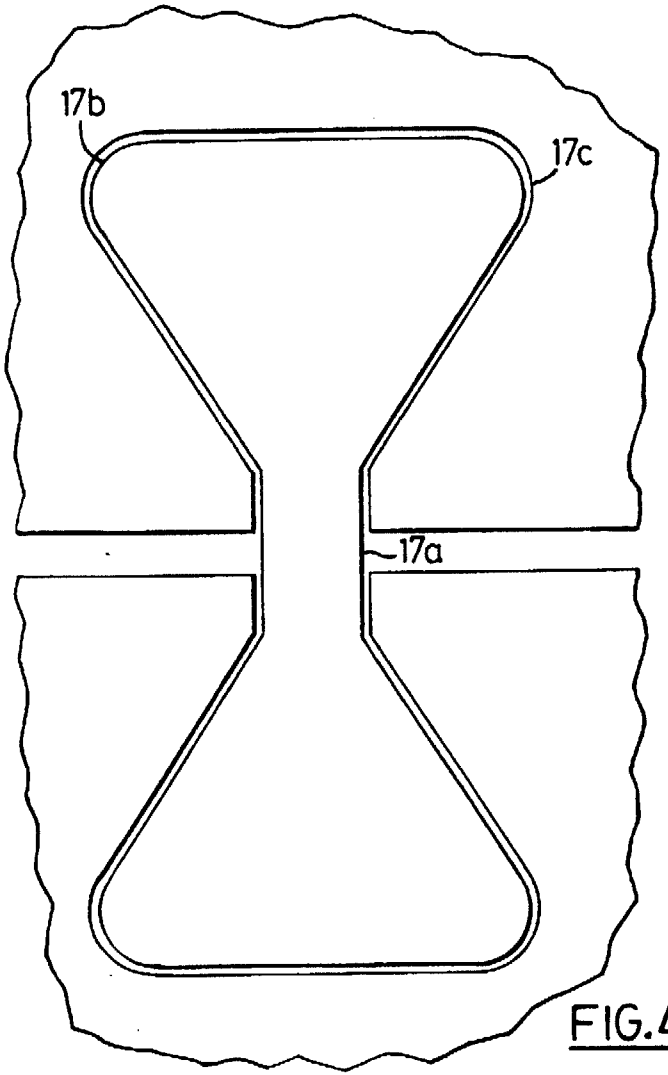
Figure 7:
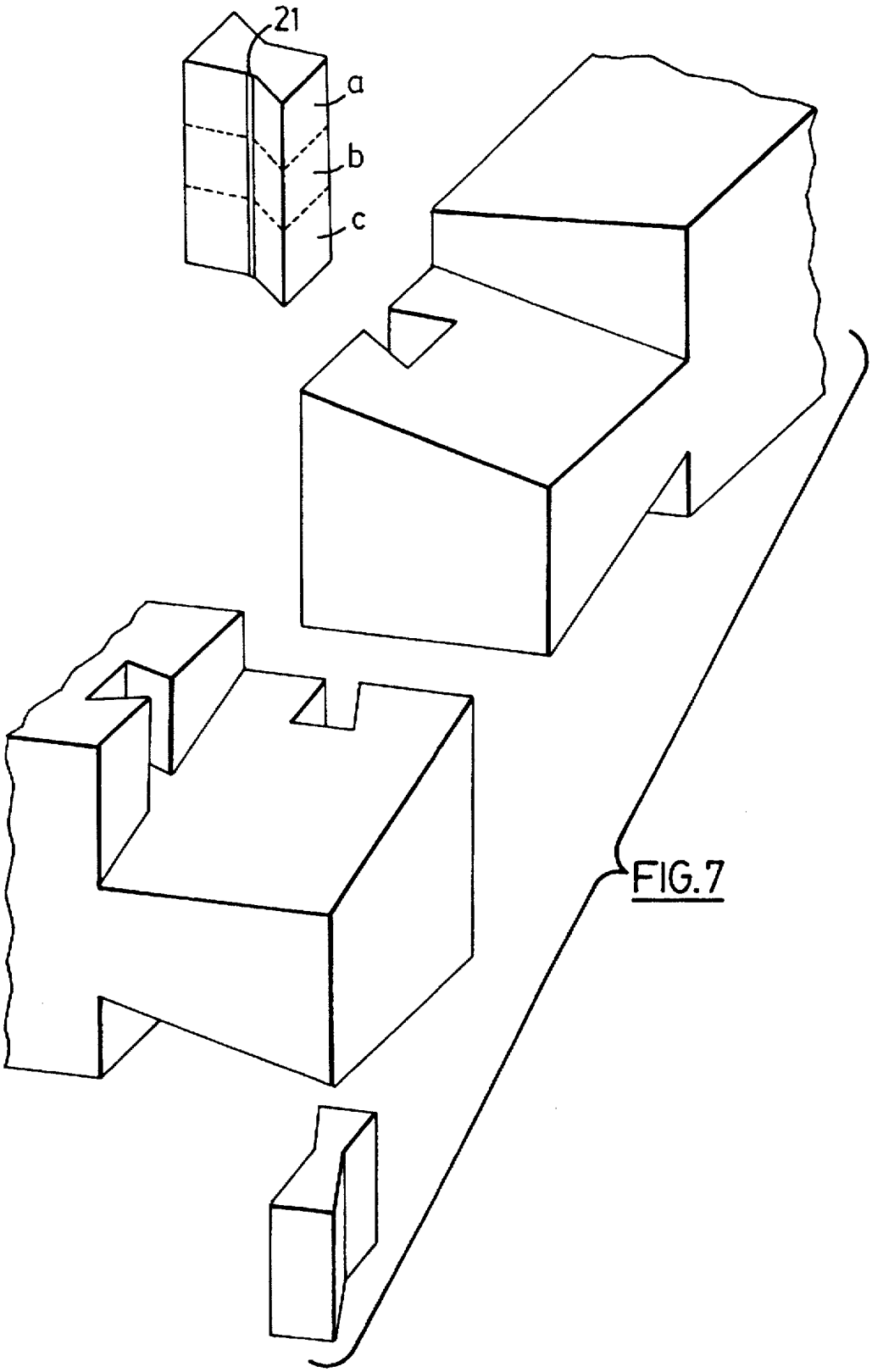
FIG. 7 is a fragmentary assembly view of still another log construction.

Preferably, the projections are symmetrically arranged along the common central axis 'A'. The outer surfaces of each of the projections diverge from the boundary relative to the axis. More preferably, the projections are triangular in cross section, for example 'wedge shaped'. In another embodiment, as shown in FIG. 4a, the central portion has parallel opposing side faces 17a and the outer corners are rounded as shown at 17b, 17c. In still another embodiment, the projection has circular divergent outer surfaces 19a, 19b as shown in FIG. 4b. The log construction can also utilize a number of known log joinery techniques, such as a dove tail joint as shown in FIG. 7, which also makes use of a central portion with parallel opposing side faces as shown at 21.

A particular feature of the log construction is that the barrier and the logs may be formed from materials with different "coefficients of shrinkage", a term which is intended to refer to the degree to which a particular material shrinks over a predetermined period of time and may be expressed by some ratio of the 'pre-shrink' length and the 'post-shrunk' length of a unit sample of the material. For example, green softwood such as pine or spruce should shrink to a greater extent (and therefore have a correspondingly higher coefficient of shrinkage) than a green hardwood, and to a much greater extent than a substantially cured hardwood, as one might obtain after an appropriate period of kiln or air drying, for example.

Preferably, the barrier and the logs are both formed from wood materials, while the barrier is formed from material with a lower shrinkage coefficient than the material of the logs. Still more preferably, the barrier is formed from hardwood materials and the logs are formed from softwood materials. More particularly, the barrier is formed from a single piece of substantially cured hardwood and the softwood material is green.

Conveniently, the barrier and the passages are dimensioned so that the barrier can be installed in place by slidable engaging the barrier with the passages during assembly.

Figure 5:
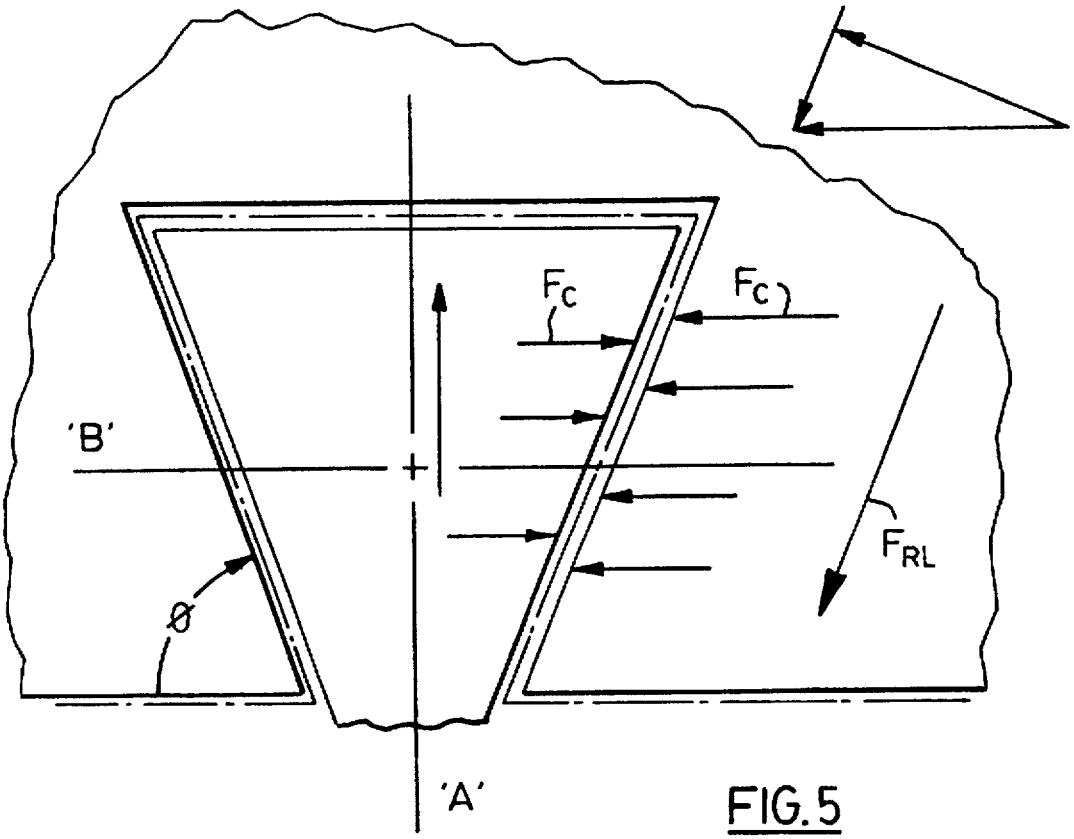
FIG. 5 is a magnified fragmentary schematic plan view of the log construction of FIG. 4.

Surprisingly, the compressive forces arising between the barrier and its associated end region from the natural effects of shrinkage may be directed to draw the end regions so coupled into tighter engagement without the need for additional locking or wedging hardware. As can be seen in FIG. 5, the green softwood of the end region tends to shrink over time, thereby making the passage smaller in cross sectional area shown by the chain dotted lines, that is it has a relatively high coefficient of shrinkage. Because the barrier itself, in this particular example, is made from a substantially cured hardwood, it should not shrink to any measurable degree and therefore has a significantly smaller coefficient of shrinkage. The barrier, as a result, will become more tightly engaged within the passage as it reduces in size, thereby causing, in effect, a squeezing action on the barrier.

Figure 6:
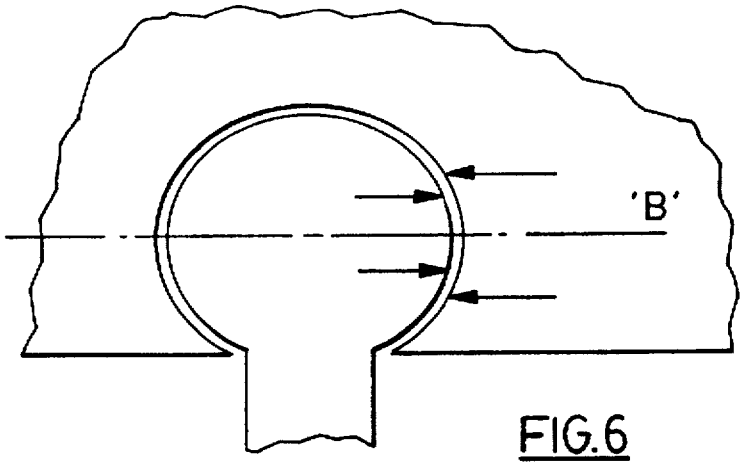
FIG. 6 a magnified fragmentary schematic plan view of another log construction.

A particular aspect here is the arrangement of the inner and outer surfaces which, though symmetrical relative to the common central axis 'A', the surfaces are not symmetrical about a central transverse axis shown 'B', as might otherwise occur if the cross section of the projection were, for example symmetrically circular or ellipsoid in cross section, as shown in FIG. 6. In other words, the compressive forces exerted on a circular projection by its corresponding passage on one side of the transverse axis, would balance themselves off with the forces on the opposite side of the transverse axis, resulting in substantially no residual forces emerging therefrom.

In the case of the embodiment of FIG. 5, the compressive forces $F_c$ on one side of the transverse axis do not balance those on the other side and infact they reinforce one another and this resulting residual force is directed toward the boundary and has the effect of drawing both end regions inwardly toward one another at the boundary. This residual force is generated between the surfaces which are arranged in a divergent manner away from the opening to the boundary, and in the case of the triangular cross section, have no corresponding convergent surfaces that would otherwise balance to create a substantially zero residual force relative to the common central axis. Thus, the outer surfaces are asymmetrically arranged relative to the transverse axis. The residual forces therefore are caused by the compressive forces $F_c$ generated at the intersection of the inner and outer surfaces and more particularly to the component thereof in the direction of the common central axis, as shown at $F_{RL}$ and $F_{RK}$. In other words, the force $F_{RL}$ tends to force the end region toward the boundary while the force $F_{RK}$ tends to force the key away from the boundary, the net effect being biasing of the end regions together to minimize the spacing therebetween at the boundary and to form a snug connection therebetween. In order to provide these compressive forces, the angle of the inner surface of the passages may be at an angle $\Theta$ ranging from 45 to 85 degrees and more preferably about 80 degrees.

It will be understood, that the surfaces may come in any number of different configurations, provided that they arranged in a similar manner as above.

The joining technique shown herein above is particularly useful because it is simple to install and requires no additional tightening manoeuvres with additional wedging devices. Rather, the present technique makes use of the natural compressive forces caused by the natural shrinkage of the materials. The same technique can be used to form butt joints and corner joints in the same log construction thereby reducing the number of parts necessary for a particular construction.

Figure 3:
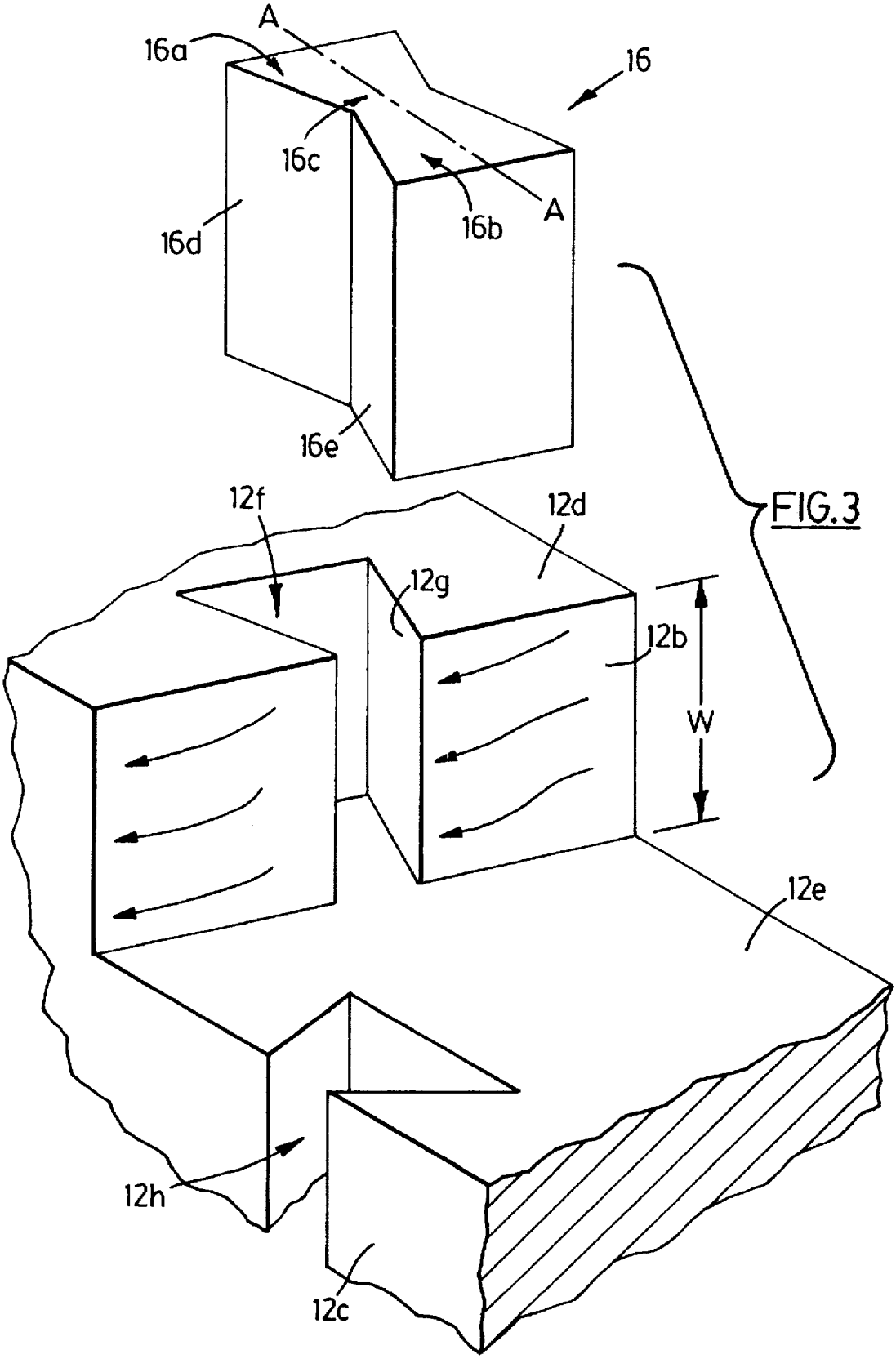
FIG. 3 is a magnified fragmentary perspective assembly view of one portion the log construction of FIG. 1.

The length of the keys depends on the length 'W', which of course will depend on the thickness of the logs and the profile of the particular joint pattern used, the intention being that the key extends the entire length 'W'. By extending the entire length, the key can provide an effective barrier against the infiltration of air through the log wall as would otherwise occur through the boundary as shown by the arrows in FIG. 3.

However, the entire length may also be spanned by more than one single barrier. The single barrier may be replaced with, for example, three keys, all with a collective length equalling that of the single key as shown at 21*a, b, c* in FIG. 7.

The log construction may be formed in the following manner. First, the logs 12, 14 are cut to length and their end regions are shaped so as to engage in a complementary fashion as shown above. The barrier receiving passages 12*f*, 14*f*, 12*g*, 14*g* are formed so that they extend from the outer surface 12*d*, 14*d* to the intermediate surface 12*e*, 14*e*. The keys are then formed with a cross section which is complementary to that of the aligned passages.

The keys may be slightly undersized in the direction of the axis 'A' in order to immediately establish a loaded condition with the bearing surfaces. With the logs in their position with the passages aligned, the keys may then be pressed in place with appropriate caulking compounds placed therein as necessary. The joint may then be left to the forces of nature to bring about the shrinkage of the materials to establish the residual forces as described.

The cross sections used herein have the additional benefit of increasing the engaged surface area of the inner and outer surfaces, both to increase the area which is available for caulking materials, if desired, or to otherwise increase the distance that infiltrating air would need to travel to circumvent the barrier so formed.

The key may, if desired, by dimensioned to extend beyond a single joint. For example, the keys may extend beyond two or more joints as shown in the log construction 30 shown in FIG. 8. In this case, there are provided two sets of logs 32, 34, with each set having a number of aligned end regions 32*a*, 34*a*, with each log element from set 32 formed to engage a pair of adjacent logs in set 34. There is provided a series of first surface portions as shown at 32*b*, and a series of second surface portions as shown at 32*c*.

Figure 8:
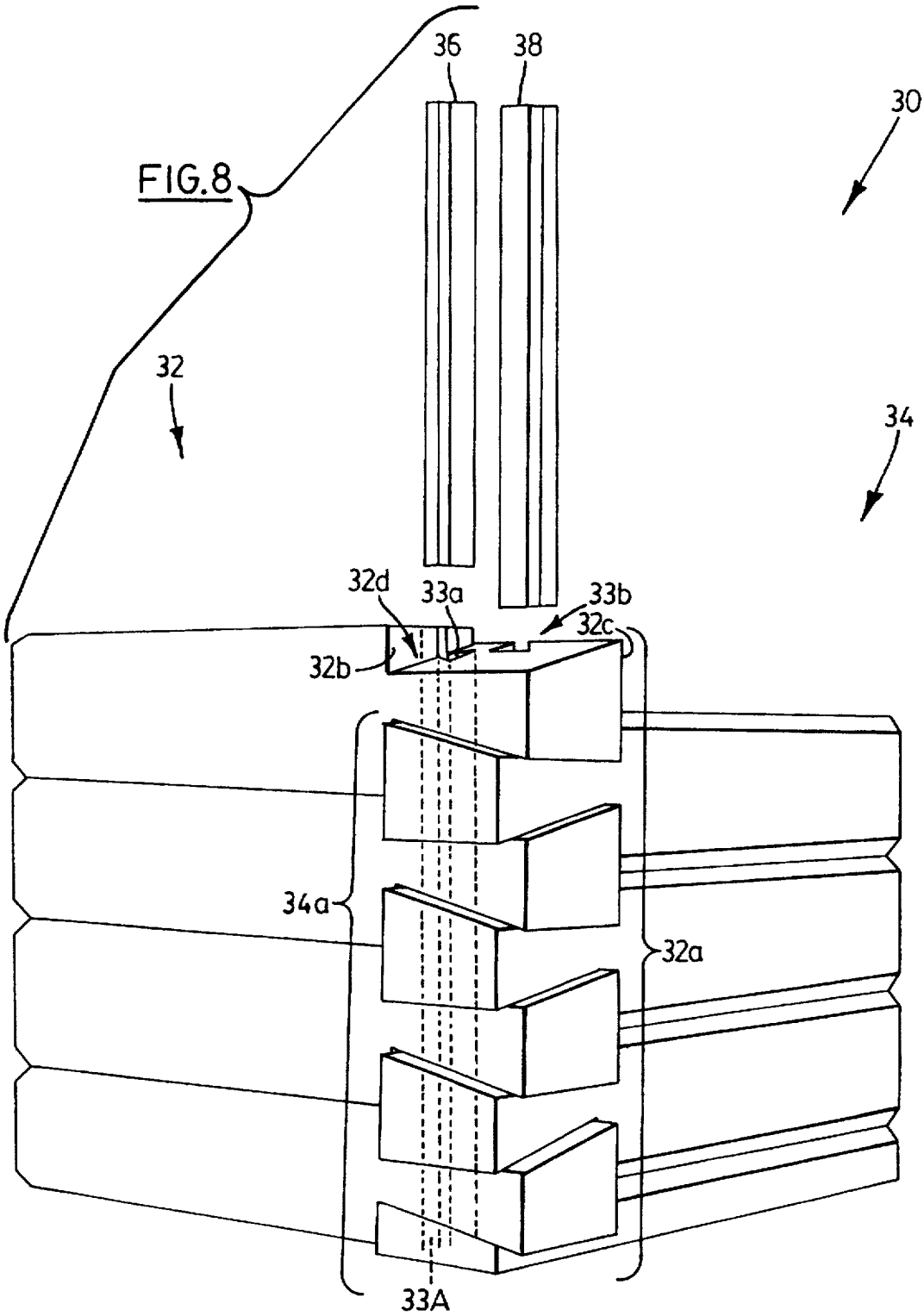
FIG. 8 is a fragmentary perspective view of yet another log construction.

In this case, each log is also provided with barrier receiving passages 33*a*, 33*b*, each of which extends the full thickness of the log so that, when assembled as shown in FIG. 8, the passages 33*a*, 33*b* align together to form a substantially continuous elongate passage extending the full length of the so-formed log 'wall'. This is shown in the case of the passages 33*a* by the dashed lines at "33A".

A pair of keys 36, 38 engage the elongate passage 33*a*, 33*b*, thereby to interrupt the boundary between the adjacent surface portions and to inhibit relative movement between the log elements of each set of logs in the construction.

The keys used herein may be formed from a number of materials. Hardwood materials such as maple and oak are readily available and provide a natural counterpart to the soft woods normally used for the logs themselves.

However, other materials such as plastics are also envisioned. In this case, the materials may be preformed into the keys as shown above or alternatively be arranged to be forced in a liquid or other deformable consistency, into the aligned passages. This technique has the advantage that the key forming material can fill the voids in the aligned passage, while accommodating minor misalignments between the logs. Furthermore, the passages can be finished in such a manner to allow the key forming material to partially or fully extend beyond the passages themselves and fill the spacing the between the adjacent surface portions. The key forming material, in this case, may be a thermoset material such as those defined as epoxies or thermoplastics such as polyethylene or polypropylene. The characteristics of the formed key may also be modified by adjusting the make up of the material, for example by adding a reinforcing fibre and the like.

Figure 9:
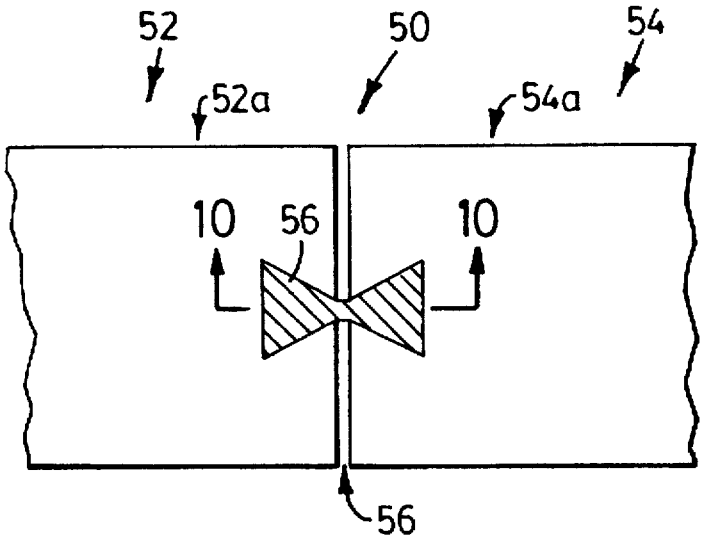
FIG. 9 is a fragmentary plan view of yet another log construction.
Figure 10:
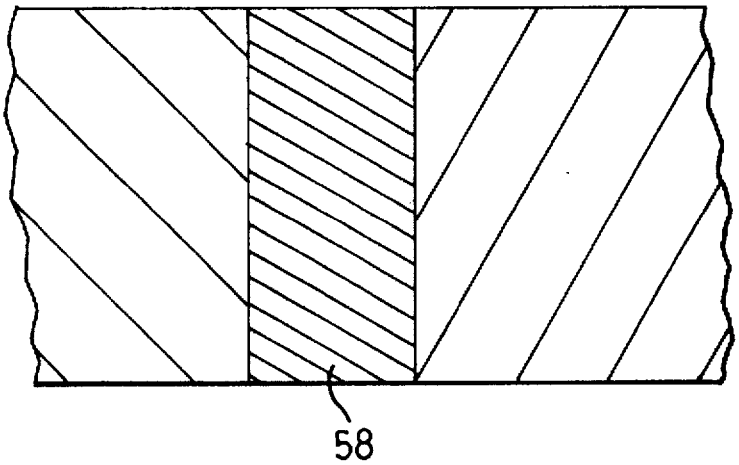
FIG. 10 is a sectional view taken on line 10—10 of FIG. 9.

Referring to FIG. 9, there is provided another log construction 50 with a pair of logs 52, 54 having complementary end regions 52*a*, 54*a*. In this case, the complementary end regions are simply a flat end face to form a butt joint having a transverse boundary 56. A barrier in the form of a key 58 is arranged in a like fashion to that shown above to interrupt the boundary along substantially the entire transverse dimension thereof, in this case, the height as shown in FIG. 10.

Figure 12:
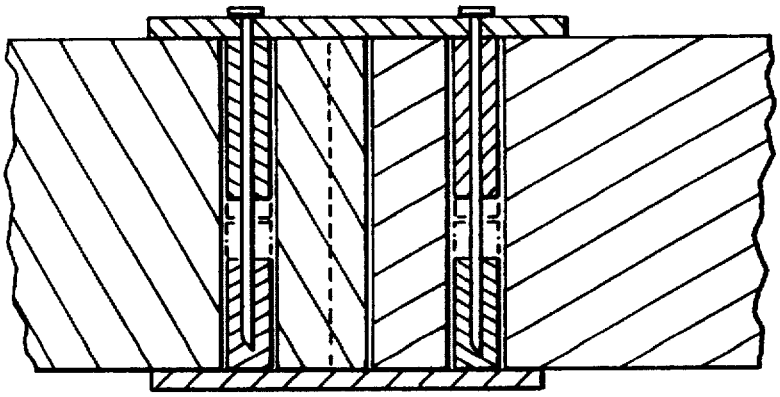
FIG. 12 is a fragmentary sectional view taken on line 12—12 of FIG. 11.
Figure 11:
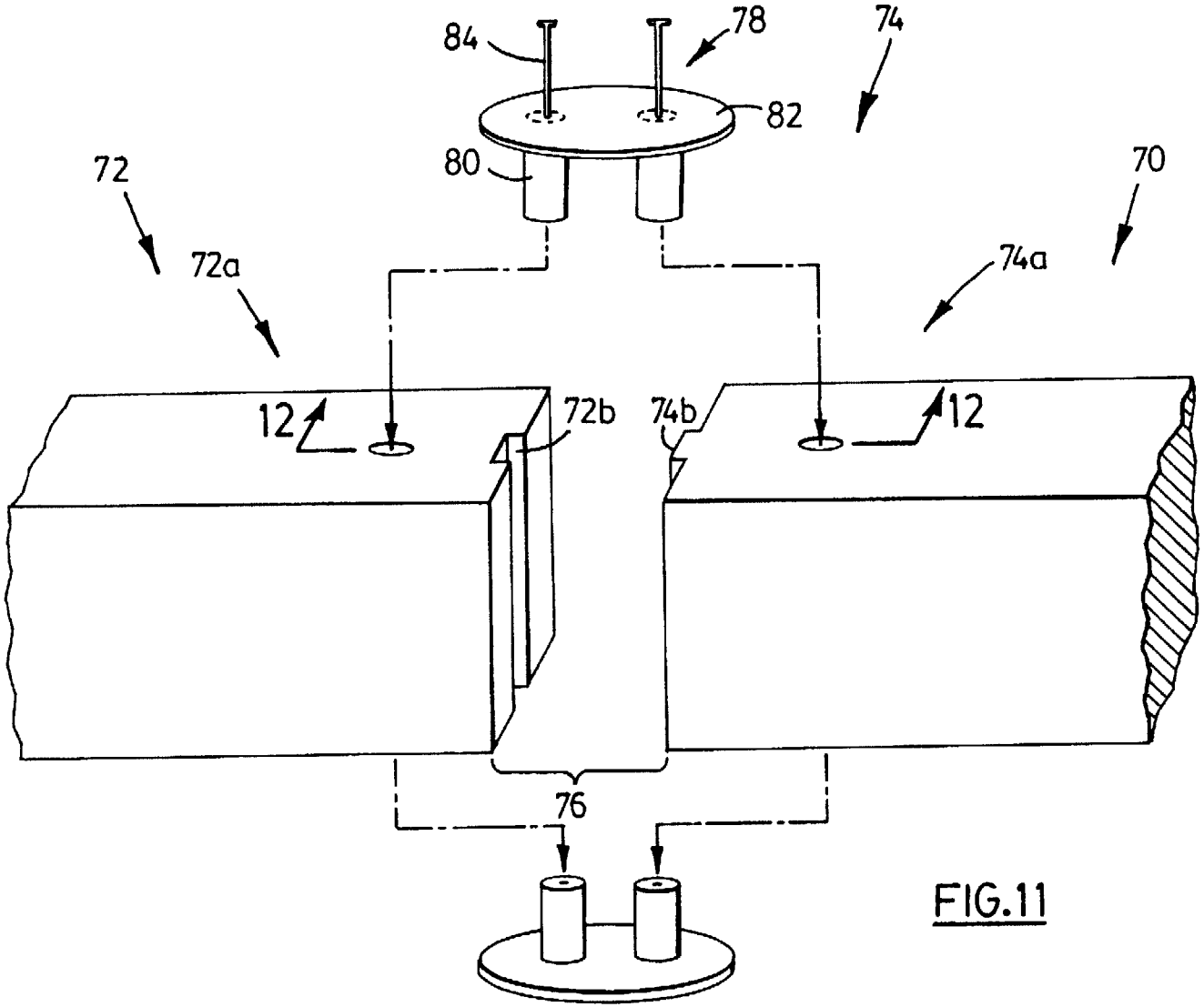
FIG. 11 is a fragmentary assembly side view of yet another log construction.

Referring to FIGS. 11 and 12, there is provided still another log construction 70 with a pair of logs 72, 74 having complementary end regions 72*a*, 74*a*. In this case, the complementary end regions are simply a flat end face to form a butt joint having a transverse boundary 76. One end face has a projection 74*b* and the other end face has a complementary recess 72*b*. A pair of fastening assemblies 78 are provided to engage each of the end regions on opposite sides thereof. Each of the fastening assemblies includes a pair of cylindrical plugs 80 mounted on a base plate 82, each plug adapted to receive a fastener such as a spike 84, by way of a small elongate passage or the like. A pair of passages extend through each of the end regions 72*a*, 74*a* and are dimensioned so as to receive a corresponding pair of plugs as shown.

The spikes are dimensioned to that they can be driven through the upper plug and project into the lower plug thereby to hold the fastening assemblies in place. The plugs are firmly mounted on the plate so that the plate can absorb the loading exerted thereon should the butt end joint. If desired, the plugs may be dimensioned to extend fully into the passages and abut one another as shown in dashed lines in FIG. 12.

I claim:

1. A log construction comprising:

a pair of logs, each having an end region with a surface portion thereon, wherein the surface portions are arranged to engage one another at a boundary therebetween, said boundary having a length, at least one barrier extending across said boundary and along the length thereof to couple said end regions together, said barrier having a pair of projections, each of said logs further comprising a passage open to and adjacent said boundary for receiving a corresponding one of said projections, each of said projections having a pair of outer surfaces and said passage having a pair of inner surfaces, said outer and inner surfaces being further arranged to generate residual compressive forces toward said boundary as a result of shrinkage between said barrier and said end regions.

2. A log construction as defined in claim 1 wherein said projections are symmetrically arranged along a common central axis.

3. A log construction as defined in claim 2 wherein said outer surfaces are asymmetrically arranged relative to a transverse axis.

4. A log construction as defined in claim 3 wherein the outer surfaces of each of said projections diverge from said boundary relative to said central axis.

5. A log construction as defined in claim 4 wherein each of said projections is triangular in cross section.

6. A log construction as defined in claim 5 wherein said barrier and said logs are formed from materials with different coefficients of shrinkage.

7. A log construction as defined in claim 6 wherein said barrier is formed from material with a lower coefficient of shrinkage than the material of said logs.

8. A log construction as defined in claim 7 wherein said barrier and said logs are both formed from wood materials.

9. A log construction as defined in claim 8 wherein said barrier is formed from hardwood materials and said logs are formed from softwood materials.

10. A log construction as defined in claim 9 wherein said barrier is formed from a single piece of substantially cured hardwood and said softwood material is green.

11. A log construction as defined in claim 10 wherein said barrier is dimensioned for slidable engagement with said passages during assembly thereof.

12. A log construction as defined in claim 11 wherein said complementary end regions form a butt joint.

13. A log construction as defined in claim 11 wherein said complementary end regions form a corner joint.

14. A method of forming a log construction comprising the steps of:

providing a pair of logs, each with an end region having a surface portion thereon, arranging the surface portions are arranged to engage one another at a boundary therebetween, said boundary having a length, providing at least one barrier to extending across said boundary and along the length thereof to couple said end regions together, said barrier having a pair of projections, forming in each of said logs a passage open to and adjacent said boundary for receiving a corresponding one of said projections, forming on each of said projections a pair of outer surfaces and in said passage a pair of inner surfaces, arranging said outer and inner surfaces to generate residual compressive forces toward said boundary as a result of shrinkage between said barrier and said end regions.

15. A method as defined in claim 14 further comprising the step of arranging said projections to be symmetrical along a common central axis and asymmetrical relative to a transverse axis.

16. A method as defined in claim 15 further comprising the steps of arranging the outer surfaces of each of said projections so as to diverge from said boundary relative to said central axis.

17. A method as defined in claim 16 further comprising the steps of forming said barrier from material with a lower coefficient of shrinkage than the material of said logs.

* * * * *